US005571452A

United States Patent [19]

Marcotullio et al.

[11] Patent Number: 5,571,452

[45] Date of Patent: Nov. 5, 1996

[54] PROCESS FOR RECOVERING AND MOVING HIGHLY VISCOUS PETROLEUM PRODUCTS

[75] Inventors: Armando Marcotullio, S. Donato Milanese; Alberto Di Lullo, Sirmione, both of Italy

[73] Assignee: Agip S.p.A., Milan, Italy

[21] Appl. No.: 341,073

[22] Filed: Nov. 17, 1994

[30] Foreign Application Priority Data

Dec. 17, 1993 [IT] Italy ..... 002648/93

[51] Int. Cl.[6] ..... B01F 17/12

[52] U.S. Cl. ..... 252/312; 137/13

[58] Field of Search ..... 252/312, 353, 252/355; 562/33; 137/13

[56] References Cited

U.S. PATENT DOCUMENTS

| | | | |
|---|---|---|---|
| 1,422,564 | 7/1922 | Grob et al. | 562/98 |
| 2,061,618 | 11/1936 | Downing et al. | 562/123 |
| 2,865,958 | 12/1958 | Davies et al. | 562/33 |
| 4,261,916 | 4/1981 | Crosby | 558/33 |
| 4,424,169 | 1/1984 | Swedo | 562/33 |
| 4,426,313 | 1/1984 | Swedo | 252/353 |
| 4,692,270 | 9/1987 | Sato | 252/353 |
| 4,898,685 | 2/1990 | Kanekiyo et al. | 252/353 |
| 4,915,708 | 4/1990 | Prevedello et al. . | |
| 5,349,101 | 9/1994 | Lutz et al. | 558/36 |
| 5,364,960 | 11/1994 | Marcotullio et al. . | |
| 5,445,179 | 8/1995 | Di Lullo et al. . | |

FOREIGN PATENT DOCUMENTS 1241015 8/1988 Canada .

*Primary Examiner*—Charles T. Jordan
*Assistant Examiner*—John R. Hardee
*Attorney, Agent, or Firm*—Oblon, Spivak, McClelland, Maier & Neustadt, P.C.

[57] ABSTRACT

Process for recovering and moving highly viscous petroleum products, by the use of aqueous dispersions in the presence of sulphonate dispersers prepared:

a) by increasing the molecular weight of steam cracking fuel oil by its oligomerization in the presence of a catalyst selected from $BF_3$ and complexes thereof with strong acids;

b) sulphonating the compound obtained from step (a) by reaction with a sulphonating agent, preferably $SO_3$;

c) neutralizing the sulphonate obtained from step (b) by treatment with hydroxides selected from the hydroxides of alkaline or earth alkaline metals or ammonium.

17 Claims, No Drawings

PROCESS FOR RECOVERING AND MOVING HIGHLY VISCOUS PETROLEUM PRODUCTS

The present invention relates to a process for moving highly viscous petroleum residues.

Moving through pipes highly viscous petroleum products or residues, particularly those with an API grade of less than 15, is difficult owing to their high viscosity and therefore low mobility.

A method for improving the movement and recovery of these highly viscous products consists in adding hydrocarbons or lighter crude products thereto. This mixing diminishes the viscosity of the system and consequently increases the mobility, but has the disadvantage of requiring considerable investments and is therefore very costly. In addition light fractions or crude products are not often available.

Another method for improving the fluidity of highly viscous products in pipes, consists in installing heating elements at frequent intervals along the pipe; in this way the crude or petroleum product thus heated has a lower viscosity and is therefore easier to transport. These heating elements can be operated using part of the transported product as fuel. This technique can give a loss of 15–20% of the transported product.

Another method for moving heavy petroleum products or residues consists in pumping them through the pipe in the form of more or less fluid aqueous emulsions. These emulsions are of the oil in water type and are therefore much more fluid to move than the crude product.

The oil in water emulsions, prepared by adding water and emulsifying agent under stirring to the oil to be moved, are then pumped into the pipe.

The emulsifying agent must produce a stable and fluid oil in water emulsion with a high percentage of oil.

To ensure that the process is advantageous, the emulsifying agent must not be expensive and must give stable emulsions during the pumping period.

The emulsifying agents proposed so far do not completely satisfy the above requisites.

For example, U.S. Pat. Nos. 4,246,920, 4,285,356 4,265,264, and 4,249,554 describe emulsions having only a 50% content of oil in water; under these conditions this means that half of the volume of the pipe is not available for the transport of petroleum.

On the other hand Canadian patents 1,108,205, 1,113,529 and 1,117,568 and also U.S. Pat. No. 4,246,919 describe quite low reductions in viscosity, in spite of the relatively low proportion of oil.

U.S. Pat. No. 4,770,199 discloses emulsifying agents consisting of complex mixtures of non-ionic alkoxylate surface-active agents with ethoxylate-propoxylate carboxylates. The non-ionic surface-active agent of the above mixture is obviously sensitive to temperature, and can therefore become insoluble in water under certain conditions of temperature. In addition the above surface-active agents are very expensive and affect the economic aspect of the process.

Finally EP-B-237,724 uses as emulsifying agents mixtures of ethoxylate carboxylates and ethoxylate sulphates, products which are not easily available on the market and are quite costly.

The co-pending patent applications of the Applicant IT-MI 92-A-001712 and IT-MI-92-A-001643 describe a process for moving highly viscous petroleum fractions by the formation of aqueous dispersions in the presence of dispersers characterized by a high solubility in water and limited lowering of the surface tension of the water itself. In particular in IT-MI 92-A-001643 dispersers are used, deriving from the oxidative sulphonation with $SO_3$ of particular aromatic fractions, among which steam cracking fuel-oil. The above oxidative sulphonation reaction causes a sulphonation of the prevalently aromatic substrate and at the same time an increase in the molecular weight with the formation of $SO_2$. The process, described in EP-A-379,749, involves reaction with $SO_2$ under conditions which also allow oxidative polymerization. The above process has the disadvantage that the increase in molecular weight is not easy to control. As a result it is difficult to control the increase in molecular weight in the reaction phase.

It has now been found that particular sulphonate dispersers, again obtained starting from steam cracking fuel-oil, are useful dispersers in moving highly viscous petroleum products. The above dispersers are obtained by a process which comprises a step for increasing the molecular weight of the steam cracking fuel oil, a sulphonation step and final neutralization by treatment with hydroxides selected from the hydroxides of alkaline or earth alkaline metals or ammonium. The process of the present invention has the advantage of enabling a better control of the degree of polymerization.

In accordance with this, the present invention relates to a process for recovering and moving highly viscous petroleum derivatives by the use of aqueous dispersions in the presence of sulphonate dispersers having a high solubility in water, characterized in that the above sulphonate dispersers are prepared starting from steam cracking fuel oil by means of the following series of steps:

a) increase of the molecular weight of the steam cracking fuel oil by its oligomerization in the presence of a catalyst selected from $BF_3$ and its complexes with strong acids, preferably the complexes $BF_3.H_3PO_4$;

b) sulphonation of the compound as obtained in step (a) by reaction with a sulphonating agent selected from oleum, concentrated sulphuric acid, $SO_3$, preferably $SO_3$;

c) neutralization of the sulphonate obtained in step (b) by treatment with hydroxides selected from the hydroxides of alkaline or earth alkaline metals or ammonium.

Steam cracking fuel oil refers to the high-boiling liquid residue resulting from the cracking of naphtha and/or gas oil to give light olefins, particularly ethylene: this fuel oil has no valid commercial use, its price being calculated according to the calorie.

Most of the world production of ethylene derives from the cracking of gas oil and/or naphtha in the presence of vapour (see Ulmann's Encyclopedia of Industrial Chemistry Vol. A 10 page 47).

The reaction by-products partly consist of gases such as hydrogen, methane, acetylene, propane, etc., liquid fractions having a boiling point from 28 to 205° C., and finally a high-boiling residue, so-called steam cracking fuel oil (hereinafter referred to as FOK).

This fuel oil is formed with yields which vary according to the operating conditions of the cracker, but mainly according to the type of feeding. The yields of fuel oil are typically 15–20% by feeding gas oil and 2–5% by feeding naphtha. Also the chemical composition varies slightly in relation to the above parameters. In any case this product has a minimum content of aromatics of 70%, usually between 80 and 90%, determined by column chromatography according to the method ASTM D2549, the complement to 100 consisting of saturated and polar products. The aromatic part of the FOK consists, for at least 75%, of aromatics and alkyl aromatics having two or more condensed rings.

At least 50% of the FOK boils at a temperature lower than 340° C., its carbon content is generally higher than 80%, the density at 15° C. higher than 0,970 kg/dm$^3$.

Step (a), i.e. the oligomerization of the steam cracking fuel oil (FOK) is carried out by putting the FOK in contact with the oligomerization catalyst, selected from $BF_3$ and its complexes with strong acids, preferably the complex $BF_3.H_3PO_4$.

If a complex between $BF_3$ and a strong acid is used as catalyst, the above complex can be used as such, or preformed, or formed in situ by the introduction into the reaction mixture of $BF_3$ and the desired acid in ratios suitable for forming the above complex. In any case it is preferable to use an excess of $BF_3$ with respect to the strong acid, the molar ratio $BF_3$/strong acid being from 20/1 to 1.5/1 preferably from 15/1 to 4/1.

Either using $BF_3$ or one of its complexes with a strong acid, it is preferable for the catalyst to be between 0.01 and 0.2 moles of Boron per 100 grams of FOK, preferably between 0.02 and 0.06 moles of Boron per 100 grams of FOK. Higher quantities of catalyst do not cause significant increases in the molecular weight.

To carry out step (a) it is preferable not to use any reaction solvent. This gives the further advantage of avoiding difficult operations for recovering the solvent.

The duration of step (a) depends on the reaction temperature selected and the ratio between the quantity of catalyst and that of the FOK. Usually a sufficient degree of oligomerization is obtained after 150 minutes at a temperature of between 70° and 90° C.

At the end of step (a) the oligomerized FOK can be separated from the catalyst using conventional procedures, for example by extraction or distillation or using a combination of the two techniques. Obviously, if the catalyst consists of $BF_3$, it will be recovered by simple distillation. In the case of a complex with a strong acid, at the end of the reaction, the possible excess of $BF_3$ with respect to the stoichiometric value with the strong acid can be separated by distillation, whereas the remaining complex can be separated by decanting the complex from the reaction crude product and subsequently washing the reaction crude product with water. Alternatively the reaction crude product, as obtained from step (a) can be used directly for step (b) after eliminating any excess $BF_3$.

Step (b) of the process of the present invention can be carried out in the presence of the usual sulphonating agents selected from oleum, concentrated sulphuric acid, $SO_3$, preferably liquid or gaseous $SO_3$.

It is preferable to operate in the presence of an inert solvent suitable for disposing of the considerable sulphonation heat. When oleum or concentrated sulphuric acid is used, the sulphuric acid can itself act as solvent. If sulphuric anhydride is used as sulphonating agent, it is preferable to use sulphur dioxide as inert diluent.

As the starting substrate has already undergone treatment for increasing the molecular weight, the sulphonation reaction (step b) does not need particular temperature conditions for increasing the molecular weight during the sulphonation phase. Consequently reaction temperatures of from 5° to 50° C., preferably between 10° and 40° C., are sufficient for carrying out the sulphonation reaction.

If sulphuric anhydride is used as sulphonating agent, the weight ratio between sulphuric anhydride and oligomerized FOK resulting from step (b) is from 0.7/1 to 1.7/1, preferably from 0.8/1 to 1.5/1.

At the end of sulphonation step (b), the product is recovered using the known techniques. When $SO_3$ is used, any possible inert solvent is eliminated, the reaction crude product is neutralized with aqueous solutions of the hydroxides of alkaline or earth-alkaline metals or ammonium, preferably sodium hydroxide, in order to recover the disperser thus produced as an aqueous solution of alkaline or earth-alkaline metal or ammonium sulphonate.

If other sulphonating agents are used, for example concentrated sulphuric acid or oleum, the sulphuric acid will be recovered after quenching and then the usual neutralization process will be carried out with hydrates of alkaline or earth-alkaline metals, preferably sodium hydrate.

An aqueous solution of the sulphonate is thus obtained, which consists (on dry product) of 70–90% of organic sulphonate usually containing a quantity of sulphonic groups of 0.35–0.70 moles for every 100 grams of organic sulphonate, whereas the remaining percentage consists of sulphate, as well as crystallization water.

The sulphonates thus obtained belong to the group of dispersers as they have a high solubility in water (sodium salt has a solubility of at least 30% by weight, generally at least 40% by weight in water) and they do not lower the surface tension of the water much.

The sulphonates thus prepared are useful for moving highly viscous petroleum products in the form of aqueous dispersions.

The term "dispersion" applies to a multiphase system, wherein one phase is continuous and at least another is finely dispersed. The term "dispersers" refers to products or mixtures of products which promote the formation of a dispersion or stabilize a dispersion.

In the process for moving petroleum products of the present invention, the continuous phase of the dispersion is water, whereas the dispersed phase consists of particles, probably both solid and liquid, of heavy petroleum product. The above aqueous dispersions are stabilized mainly electrostatically by the dispersers prepared as described above.

In the above dispersions with which the petroleum products are moved, the weight ratio between petroleum product and water can vary within a wide range, for example between 90/10 and 10/90. It is preferable however, for obvious economical reasons, to use high contents of residue, which could however cause the disadvantage of excessive viscosity.

An excellent composition of the dispersion, depending on the type of product to be moved, has a water content of between 15 and 40% by weight with respect to the total dispersion.

Also the quantity of disperser of the present invention depends on the type of product to be moved; in any case the quantity of disperser necessary for having a fluid and pumpable dispersion is between 0.4 and 1.5% by weight, these percentages referring to the quantity of dispersing agent with respect to the total quantity of water and petroleum product.

The term "highly viscous petroleum products" to be moved, refers to very viscous crude products, or petroleum residues of any origin, for example atmospheric or vacuum residues. In any case the above highly viscous petroleum products have an API gravity of less than 15° and a viscosity at 30° C. higher than 40,000 mPas.

The aqueous dispersion of the heavy petroleum product can be carried out in the following way: an aqueous solution of the salt, preferably sodium salt, of the sulphonate disperser of the present invention is added to the heavy petroleum product to be moved and the dispersion is prepared by stirring the two phases with a turbine or blade stirrer, or with centrifugal pumps.

When oil wells containing heavy crude products which cannot be moved with the usual technologies, are being exploited, the crude product can be recovered with the process described above.

In particular it is possible to inject the aqueous solution of the disperser into the well so that it enters into contact with the oil at a greater or equal depth to that of the recovery pump.

In this case the mechanical stirring action produced by the pump will be sufficient to produce a fluid dispersion at the head of the well.

In this respect, it should be pointed out that the good rheological properties, necessary for an effective recovery of the oil as an aqueous dispersion, have nothing to do with either the homogeneity of the dispersion or the dimensions of the particles (solid or liquid) dispersed in the water. In other words the process for moving highly viscous petroleum products does not require particular mixing forms, and is not associated with particular particle dimensions. In fact the crude product can be moved and recovered also when the heavy dispersed oil is in the form of particles with macroscopic dimensions.

The dispersion thus prepared is stable for storage even for long periods (in fact there is no phase separation even after several hundred hours).

In this way it is possible to freely store the above dispersion in suitable tanks and send it to the duct or ship at the right moment.

This recovery and moving technique via aqueous dispersion has other advantages which lie in the fact that it uses inexpensive products as dispersers, which come from widely available raw materials.

In fact, as the sulphonates used belong to the group of dispersers, which, unlike the usual surface-active agents, do not substantially lower the surface tension of the water and are extremely soluble in water, the aqueous dispersions of petroleum residue of the present invention do not need antifoam agents.

The following examples provide a better illustration of the present invention.

EXAMPLES

Examples 1–6 refer to the oligomerization and sulphonation of steam-cracking fuel oil.

A steam-cracking fuel oil (FOK) coming from the cracker in Priolo in Sicily is used as substrate to be polymerized.

The above FOK had the following composition:

Aromatics: 97.6%;

Saturated products: 1.2%;

Polar products: 1.1%.

The mass spectrometry at low voltage, carried out on the FOK fraction having a boiling point lower than 550° C. and corresponding to 70% by weight of the FOK as such, showed the following percentages of chemical products:

Benzenes: 3.5; Indans: 7.6; Indenes: 15.0; Naphthalenes: 25.5; Acenaphthenes: 9.2; Fluorenes: 12.4; Phenanthrenes: 9.1; Dihydropyrenes: 4.5%; Pyrenes: 6.8; Chrysenes: 3.6; Binaphthyls: 1.6; Benzopyrenes: 0.9; Benzochrysenes: 0.1; Indeno pyrenes: 0.1; Benzoperylenes: 0.1; Coronenes: 0.1.

The following percentages refer to weight % and comprise, for each group of products, the non-substituted parent and its alkyl derivatives. Usually in each single family the sum of alkyl derivative products is higher than the non-substituted parent. For example in the case of naphthalenes, naphthalene is present in a quantity of 11.1% whereas the alkyl naphthalenes amount to 14.4%.

A 1-litre autoclave made of AISI 316 with a magnetic drive stirrer (turbine) is used for the oligomerization reaction (step a).

The autoclave is equipped with:

No. 5 pin valves made of AISI 316 of which one is connected to an immersed tube and another to the head of the stirring bell;

No. 1 pressure gage made of AISI 316 with a maximum detectability of 24 kg/cm$^2$;

No. 1 thermometric tube with a thermocouple and digital indicator for revealing the reaction temperature;

No. 1 breaking disk calibrated at 12 kg/cm$^2$.

The heating of the autoclave is carried out by electric resistances connected to a control instrument equipped with a safety device for high temperatures.

The autoclave is also equipped with a cooling coil, with water circulation at about 17° C., on the resistance block and on the head of the autoclave.

The same autoclave is used for the sulphonation step (step b).

The feeding of the $SO_3$, obtained by distillation of oleum at 65%, is carried out with a suitable distributor jacketed for the pressure difference with nitrogen. The $SO_3$ in the distributor is heated to 40°–45° C. by the circulation of vaseline oil in the jacket.

Example 1

635.7 grams of FOK from the cracker in Priolo and 3.6 grams (0.037 moles) of $H_3PO_4$ at 99% are charged into the open autoclave washed under heat with acetone and cleaned with nitrogen.

The autoclave is closed and the seal test is carried out with nitrogen at 10 kg/cm$^2$. The nitrogen is degassed, the previously weighed cylinder of $BF_3$ (titre of the $BF_3$>99%) is connected to the top valve and the autoclave is pressurized to 9 kg/cm$^2$.

The stirring of the mixture contained in the autoclave is initiated and there is an immediate increase in temperature from 19° to 42° C. in two minutes; the pressure decreases from 9 to 2.5 kg/cm$^2$.

After two minutes the autoclave is repressurized with $BF_3$ from 2.5 to 6 kg/cm$^2$ and the stirring is stopped for a few seconds. The stirring is restarted and the temperature increases from 42° to 51° C. in three minutes. In this phase the pressure decreases from 6 to 3.5 kg/cm$^2$.

The autoclave is heated from 51° to 70° C. in 15 minutes and the mixture is left to react under stirring for 120 minutes. After 20 minutes of reaction, the pressure of $BF_3$ is 1.4 kg/cm$^2$ and after 140 minutes is 1.1 kg/cm$^2$ at 72° C.

After 140 minutes of reaction, the cylinder of $BF_3$ is disconnected and then weighed: the consumption of $BF_3$ proves to be 20.8 grams corresponding to 0.307 moles.

The autoclave is degassed, still at about 70°–72° C., and the gases are sent to NaOH traps. The autoclave is subsequently washed with nitrogen, is opened and 619.8 grams of product are recovered.

The molecular weight of the product obtained proves to be 3.5 times more than the FOK charged.

The determination of the molecular weight of the reaction product is carried out by measuring the viscosity of solutions (in methylene chloride) at different concentrations of the starting FOK and of the FOK after reaction with $BF_3.H_3PO_4$. In this way the intrinsic viscosity of the two is determined, and the molecular weight value of the oligomerized FOK with respect to the FOK charged for reaction, is obtained from the ratio between the two viscosities.

Example 2

The same procedure described in example 1 is carried out, but using a 5 litre autoclave.

3223.5 grams of FOK from the cracker in Priolo and 19.3 grams (0.197 moles) of phosphoric acid at 99% are charged into the open autoclave.

The autoclave is closed, the seal tests are carried out with nitrogen at 10 gk/cm$^2$, the nitrogen is degassed, the $BF_3$ cylinder is connected and the auto-clave is pressurized at 6 kg/cm$^2$. The mixture is stirred and after 5 minutes the autoclave is repressurized with $BF_3$ from 5 kg/cm$^2$ to 10 kg/cm$^2$. The reaction temperature increases from 24° to 65° C. in 35 minutes. The pressure in this phase decreases from 10 to 5 kg/cm$^2$. The autoclave is heated from 65° to 91° C. in 40 minutes and is left to react at 80°–90° C. for a further 80 minutes. During this phase the pressure decreases from 5 to 2 kg/cm$^2$. After 155 minutes the cylinder of $BF_3$ is disconnected and weighed: the consumption of $BF_3$ proves to be 69.3 grams (1.022 moles).

The pressure of residual $BF_3$ is degassed from the autoclave at 80° C. and the autoclave is washed with nitrogen. It is then opened and the product discharged.

The oligomerized FOK recovered proves to be 3,255 grams.

The molecular weight, determined as described in example 1, is 2.5 times higher than the FOK as such.

Example 3

184.6 grams of oligomerized FOK prepared as described in example 1 are charged into a 1 litre autoclave. 560 grams of liquid $SO_2$ (titre>99%) are then charged.

184.6 grams of $SO_3$ (distilled from oleum at 65% of $SO_3$) are subsequently charged into the reactor from the distributor in 25 minutes and under stirring. The temperature of the reaction mixture is maintained at between 15° and 30° C. The maximum pressure reached in the autoclave, equal to the vapour pressure of the $SO_2$, proves to be 5–6 kg/cm$^2$. The reaction heat is decreased by cooling the autoclave with water circulation in a coil.

When the $SO_3$ has been added, the mixture is left to react for 30 minutes at 20°–21° C. under stirring.

After 55 minutes the $SO_2$ is degassed from the autoclave and the gases neutralized and sent to special traps containing aqueous solutions of NaOH.

The remaining $SO_2$ is subsequently recovered at reduced pressure (about 100 torr.) and at about 10° C.–20° C. and the autoclave is cleaned with nitrogen.

The sulphonic acids thus produced are neutralized by introducing into the autoclave 933.8 grams of an aqueous solution at 18.3% of NaOH, corresponding to 170.9 grams of NaOH at 100%.

2422 grams of aqueous solution of neutralized product having a pH of 8.45, are obtained.

The aqueous solution is subsequently lyophilized obtaining 658.3 grams of crude product, having the following composition:

$Na_2SO_3$+$Na_2SO_4$=11.6%;

$H_2O$=19.4%;

active part=69.0%.

The sulphonate obtained as sodium salt at 100% corresponds to 454.2 grams.

The reaction crude product has a sodium content equal to 12.8% by weight and a sulphur content of 14.5%.

The solubility in water of the sodium salt sulphonate is higher than 40% by weight (at 22° C.).

The surface tension of the aqueous solution at 1% by weight is 58 dynes/cm (at 22° C.), against a surface tension of the reference water of 68.5 dynes/cm.

Example 4

According to the procedure described in example 3, 142.7 grams of oligomerized FOK, prepared as described in example 1, with 185.5 grams of $SO^3$ are reacted in the presence of 590 grams of $SO^3$ as solvent.

After neutralization, 2262 grams of aqueous solution of sodium salt sulphonate are obtained, corresponding to a lyophilized crude product of 408.9 grams having the following composition:

$Na_2SO_3$+$Na_2SO_4$=21.1%;

$H_2O$=6.6%;

active part=72.3%.

The reaction crude product has a sodium content equal to 17.87% and a sulphur content of 17.9%.

The sulphonate obtained as sodium salt at 100% proves to be 295.6 grams.

The solubility in water of the sodium salt sulphonate is higher than 40% by weight (at 22° C.).

The surface tension of the aqueous solution at 1% by weight is 55.2 dynes/cm (at 22° C.), against a surface tension of the reference water of 68.5 dynes/cm.

Example 5

According to the procedure described in example 3, 195.2 grams of oligomerized FOK, prepared as described in example 2, with 157.1 grams of $SO^3$ are reacted in the presence of 510 grams of $SO^2$ as solvent.

After neutralization with aqueous soda, 2370 grams of aqueous solution of sodium salt sulphonate are obtained, corresponding to a lyophilized crude product of 464.1 grams having the following composition:

$Na_2SO_3$+$Na_2SO_4$=18.5%;

$H_2O$=5.0%;

active part=76.5%.

The reaction crude product has a sodium content equal to 14.45% and a sulphur content of 16.8%.

The sulphonate obtained as sodium salt at 100% proves to be 355.0 grams.

The solubility in water of the sodium salt sulphonate is higher than 40% by weight (at 22° C.).

The surface tension of the aqueous solution at 1% by weight is 59.2 dynes/cm (at 22° C.), against a surface tension of the reference water of 68.5 dynes/cm.

Example 6

According to the procedure described in example 3, 177 grams of oligomerized FOK, prepared as described in example 2, and 246.5 grams of $SO^3$ are reacted in the presence of 520 grams of sulphur dioxide as solvent.

After neutralization with aqueous soda, 2270.5 grams of aqueous solution of sodium salt sulphonate are obtained, corresponding to a lyophilized crude product of 462.6 grams having the following composition:

$Na_2SO_3$+$Na_2SO_4$=27.8%;

$H_2O$=3.6%;

active part=68.6%.

The reaction crude product has a sodium content equal to 15.97% and a sulphur content of 17.83%.

The sulphonate obtained as sodium salt at 100% proves to be 317.3 grams.

The solubility in water of the sodium salt sulphonate is higher than 40% by weight (at 22° C.).

The surface tension of the aqueous solution at 1% by weight is 58.5 dynes/cm (at 22° C.), against a surface tension of the reference water of 68.5 dynes/cm.

Example 7

The sulphonates prepared as described in examples 3–6 are used for moving highly viscous petroleum fractions. The data of these tests are shown in table 1.

Crude "Gela oil" is used as petroleum fraction, with a high content of aromatics having the following characteristics:

viscosity at 30° C.: 60,000–100,000 mPas;

API degree: 7–10.

The initials OG 22 refers to the above crude product with water-cut =16% whereas OG 92 refers to the same crude product with water-cut <2%.

The tests were carried out using both bidistilled water (initials FW) and reservoir water, concentrated ¼ by weight, to which $CaCl_2$ and NaCl had been added to obtain a concentration of $Na^+$ions=4.06%, $Ca^{++}$ions=0.68% approximately and $Cl^-$ions=5.5%.

The ratio crude product/water is 70/30 weight/weight, whereas the concentration of the disperser is 0.5% with respect to the total concentration of the dispersion.

The dispersion is carried out by adding the petroleum product, at room temperature or higher to make it more fluid, to an aqueous solution of the disperser. The stirring is initally manual and subsequently using a turbine at about 5000 rpm for 10–60 seconds.

The aqueous dispersions thus prepared are left to rest at room temperature (about 20°–22° C.) periodically controlling that the phases have not separated. Table 1 shows the rheological properties of the above dispersions after 240 hours from their preparation.

The above rheological measurements are carried out with a Haake RV12 rheometer with bob-cup geometry (model MVI P, bob radius 20.04 mm, cup radius 21.00 mm, bob height 60 mm) and a shagreened bob to reduce any possible slip phenomena. The bottom of the bob has been drawn-back so that, when the bob is being introduced into the dispersion, an air bubble capable of minimizing the edge effects, is withheld. All the measurements were carried out at 33° C.

Table 1 shows the viscosity at $5sec^{-1}$ and at $50sec^{-1}$ and the yield stress. The latter, or minimum stress necessary to move a mass of fluidified crude product, was determined with extrapolations. The method used is based on the Casson model, which consists in producing a graph of the square root of the stress against the square root of the shear rate and in the rectilinear extrapolation to zero of the curve so obtained. The square root of the intercept value with shear rate zero gives the required yield stress value.

TABLE 1

| Add. EX. | Oil | Water | V. $5s^{-1}$ mPa · s. | V. $50s^{-1}$ mPa · s. | yield stress Pa |
|---|---|---|---|---|---|
| 5 | OG22 | RWC | 1000 | 300 | 3.0 |
| 3 | " | " | 950 | 800 | 2.5 |
| 4 | " | " | 930 | 730 | 1.0 |

TABLE 1-continued

| Add. EX. | Oil | Water | V. $5s^{-1}$ mPa · s. | V. $50s^{-1}$ mPa · s. | yield stress Pa |
|---|---|---|---|---|---|
| 6 | " | " | 950 | 800 | 1.5 |
| 3 | OG92 | FW | 350 | 250 | 0 |
| 5 | " | " | 380 | 250 | 0 |
| 6 | " | " | 200 | 200 | 0 |
| 4 | " | " | 135 | 120 | 0 |

The data of Table 1 show the drastic decrease in viscosity of the above additivated dispersions compared to the viscosity of the starting oil.

We claim:

1. Process for recovering and moving highly viscous petroleum derivatives by the use of aqueous dispersions in the presence of sulphonate dispersers having high solubility in water, wherein the above sulphonate dispersers are prepared starting from steam cracking fuel oil with the following series of steps:

a) increase of the molecular weight of the steam cracking fuel oil by its oligomerization in the presence of a catalyst selected from $BF_3$ and its complexes with strong acids;

b) sulphonation of the compound as obtained in step (a) by reaction with a sulphonating agent selected from oleum, concentrated sulphuric acid, $SO_3$;

c) neutralization of the sulphonate obtained in step (b) by treatment with hydroxides selected from the hydroxides of alkaline or earth alkaline metals or ammonium.

2. Process according to claim 1, wherein the quantity of catalyst in step (a) is from 0.01 to 0.2 moles of Boron per 100 grams of steam cracking fuel oil.

3. Process according to claim 2, wherein the quantity of catalyst in step (a) is from 0.02 to 0.6 moles of Boron per 100 grams of steam cracking fuel oil.

4. Process according to claim 1, wherein the catalyst used in step (a) is a complex between $BF_3$ and a strong acid.

5. Process according to claim 4, wherein the catalyst is a complex between $BF_3$ and phosphoric acid.

6. Process according to claim 4, wherein the molar ratio $BF_3$/strong acid is from 20/1 to 1.5/1.

7. Process according to claim 6, wherein the molar ratio $BF_3$/strong acid is from 15/1 to 4/1.

8. Process according to claim 4, wherein the catalyst is formed in situ by charging the strong acid and $BF_3$ into the reactor.

9. Process according to claim 1, wherein the sulphonating agent in step (b) is $SO_3$.

10. Process according to claim 9, wherein the weight ratio between $SO_3$ and the product deriving from step (b) is from 0.7/1 to 1.7/1.

11. Process according to claim 10, wherein the weight ratio between $SO_3$ and the product deriving from step (b) is from 0.8/1 to 1.5/1.

12. Process according to claim 1, wherein the water content of the dispersion is between 15 and 40% with respect to the total weight of the dispersion.

13. Process according to claim 1, wherein the quantity of sulphonate disperser is between 0.2 and 2.5% with respect to the total weight of the dispersion.

14. Process according to claim 13, wherein the quantity of disperser is between 0.4 and 1.5% by weight with respect to the total weight of the dispersion.

15. Process according to claim 1, wherein the highly viscous petroleum product has a gravity of less than 15° API.

16. Pumpable aqueous dispersion of a highly viscous petroleum product in water, which comprises a petroleum product which is very viscous for 60–85%, one or more dispersers prepared according to the steps described in claim 1 in a quantity of 0.2 to 2.5%, the complement to 100 being water.

17. Pumpable aqueous dispersion according to claim 16, wherein the disperser is in a quantity of 0.4 to 1.5% by weight.

* * * * *